US008443738B2

(12) United States Patent
James et al.

(10) Patent No.: US 8,443,738 B2
(45) Date of Patent: May 21, 2013

(54) HIGH-SECURITY ENCLOSURE

(75) Inventors: Brent A. James, Orchard Park, NY (US); Aron J. King, Alden, NY (US); Michael R. Cosley, Crystal Lake, IL (US)

(73) Assignee: Diversified Control, Inc., Orchard Park, NY (US)

( * ) Notice: Subject to any disclaimer, the term of this patent is extended or adjusted under 35 U.S.C. 154(b) by 491 days.

(21) Appl. No.: 12/729,504

(22) Filed: Mar. 23, 2010

(65) Prior Publication Data

US 2010/0236298 A1 Sep. 23, 2010

Related U.S. Application Data

(60) Provisional application No. 61/162,429, filed on Mar. 23, 2009.

(51) Int. Cl.
*E05G 1/04* (2006.01)

(52) U.S. Cl.
USPC ..... 109/59 R; 109/58.5; 109/74; 70/63; 70/86; 70/118

(58) Field of Classification Search
USPC ..... 70/102–104, 113, 118–120, 130, 70/131, 158–161, 63, 85, 86; 109/59 R, 45, 109/58.5, 74, 77
See application file for complete search history.

(56) References Cited

U.S. PATENT DOCUMENTS

| | | | | | |
|---|---|---|---|---|---|
| 2,823,536 | A * | 2/1958 | Watson | 70/1.5 |
| 2,852,926 | A * | 9/1958 | Chervenka | 70/79 |
| 3,175,873 | A * | 3/1965 | Blomquist et al. | 312/296 |
| 3,183,863 | A * | 5/1965 | Jeffres | 109/59 R |
| 4,145,978 | A * | 3/1979 | Johnson et al. | 109/59 R |
| 4,754,715 | A * | 7/1988 | Squires | 109/59 T |
| 5,067,755 | A * | 11/1991 | James | 292/33 |
| 5,088,776 | A * | 2/1992 | James | 292/33 |
| 5,280,755 | A * | 1/1994 | Batur | 109/59 R |
| 5,946,953 | A * | 9/1999 | Feldpausch | 70/78 |
| 6,698,258 | B2 * | 3/2004 | Westwinkel | 70/85 |
| 6,722,167 | B1 * | 4/2004 | Hsu | 70/78 |
| 6,772,612 | B2 * | 8/2004 | Carson | 70/63 |
| 6,883,440 | B1 * | 4/2005 | Correia | 109/59 R |
| 6,907,830 | B2 * | 6/2005 | Guinan et al. | 109/24.1 |
| 7,188,570 | B2 * | 3/2007 | Schluter et al. | 109/59 R |
| 7,387,076 | B2 * | 6/2008 | Bauman et al. | 109/59 R |
| 7,404,363 | B2 * | 7/2008 | Dunstan | 109/70 |
| 7,549,552 | B2 * | 6/2009 | Hasegawa et al. | 220/323 |
| 7,591,157 | B2 * | 9/2009 | O'Neill et al. | 70/118 |
| 7,690,159 | B1 * | 4/2010 | Arnold | 52/167.1 |
| 7,793,600 | B2 * | 9/2010 | Dunstan | 109/70 |

* cited by examiner

*Primary Examiner* — Suzanne Barrett
(74) *Attorney, Agent, or Firm* — Walter W. Duft

(57) ABSTRACT

A high-security enclosure includes a base, a cover and a lock system. The lock system includes a base portion and a cover portion. The lock system base portion includes one or more fixed lock bars. The lock system cover portion includes one or more movable lock bars. Each movable lock bar is generally perpendicular to, and arranged to engage, one of the fixed lock bars. The lock system cover portion further includes a lock bar retraction assembly coupled to the one or more movable lock bars for retracting the movable lock bar(s) substantially simultaneously out of engagement with the fixed lock bar(s). A security drive mechanism is coupled to the lock bar retraction assembly to drive the lock system.

25 Claims, 12 Drawing Sheets

HIGH-SECURITY ENCLOSURE

CROSS-REFERENCE TO RELATED APPLICATIONS

This application claims the benefit under 35 U.S.C. 119(e) of the filing date of U.S. Provisional Patent Application No. 61/162,429 filed on Mar. 23, 2009 and entitled "High-Security Enclosure. The entire contents of Application No. 61/162,429 are hereby incorporated herein by this reference.

BACKGROUND OF THE INVENTION

1. Field of the Invention

The present invention relates to lockable enclosures. More particularly, the invention concerns security enclosures for housing equipment, including but not limited to, electrical equipment, such as components for cable television, cable data, telephone and other communication systems.

2. Description of the Prior Art

By way of background, lockable enclosures have many uses. One application is for housing electrical equipment used for providing telecommunication services. For example, lockable security enclosures are commonly used to house junction connectors, taps, and other electrical components for communication systems that provide cable television, cable data, telephone and other network services to residential and business premises. Because such enclosures are often located in publicly accessible areas, they are usually provided with a security lock structure that prevents access for unauthorized purposes, such as making an illegal service hookup. It is to improvements in the security features of lockable enclosures that the present invention is directed.

SUMMARY OF THE INVENTION

A high-security enclosure includes a base, a cover and a lock system. The lock system includes a base portion and a cover portion. The lock system base portion includes one or more fixed lock bars. The lock system cover portion includes one or more movable lock bars. Each movable lock bar is generally perpendicular to, and arranged to engage, one of the fixed lock bars. The lock system cover portion further includes a lock bar retraction assembly coupled to the one or more movable lock bars for retracting the movable lock bar(s) substantially simultaneously out of engagement with the fixed lock bar(s). A security drive mechanism is coupled to the lock bar retraction assembly to drive the lock system.

BRIEF DESCRIPTION OF THE DRAWINGS

The foregoing and other features and advantages of the invention will be apparent from the following more particular description of example embodiments, as illustrated in the accompanying Drawings in which.

DETAILED DESCRIPTION OF EXAMPLE EMBODIMENTS

Figure 1:
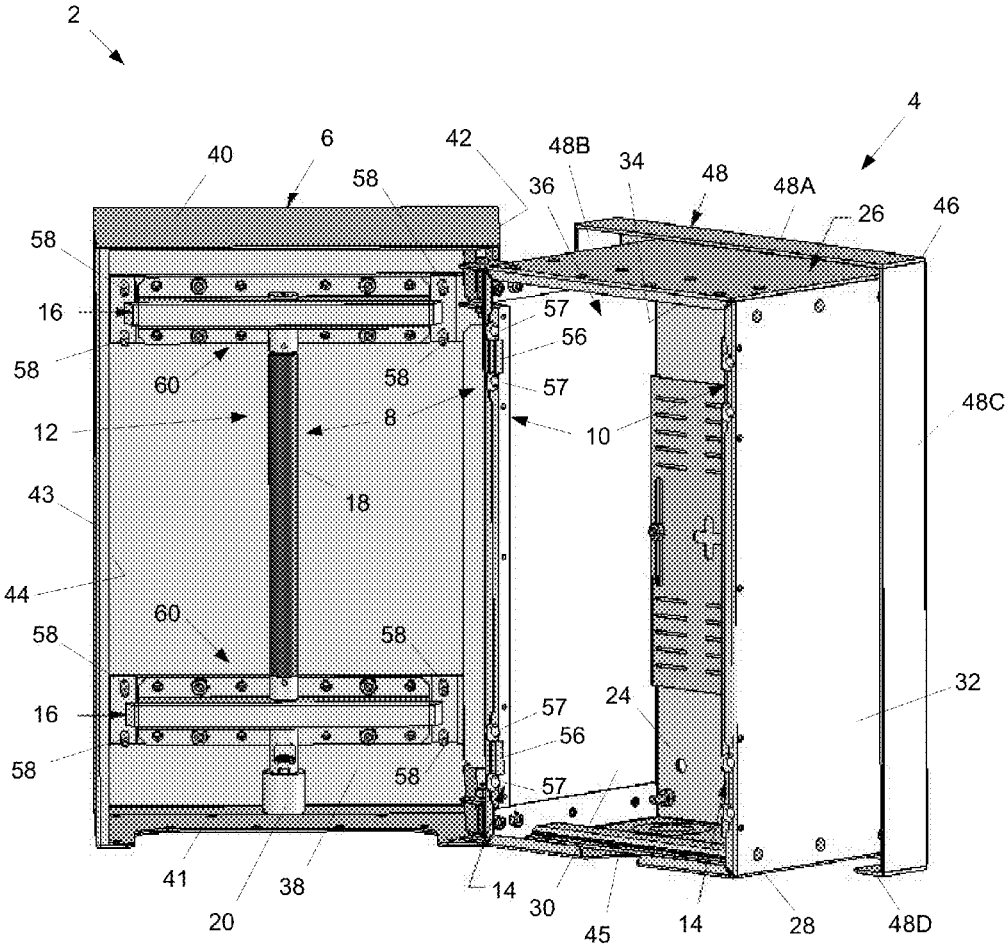
FIG. 1 is a perspective view showing an embodiment of high-security enclosure with a cover thereof in an open position relative to an enclosure base.

Turning now to the drawing figures, wherein like reference numbers represent like elements in all of the several views, FIG. 1 illustrates an example construction of a high-security enclosure 2. The enclosure 2 may be used for a variety of enclosure applications, including but not limited to, as an equipment enclosure for housing electrical components, such as for telecommunication system use. The enclosure 2 includes a base 4 and a cover 6. The base 4 and the cover 6 can be fabricated from any suitable material, including but not limited to, a durable metal such as stainless steel, a polymer-based composite material, or any other high strength metal or non-metal material that is preferably resistant to corrosion and other types of environmental degradation. Unless otherwise indicated, the remaining components of the enclosure (to be described in more detail below) may be formed from the same or similar materials.

Figure 2:
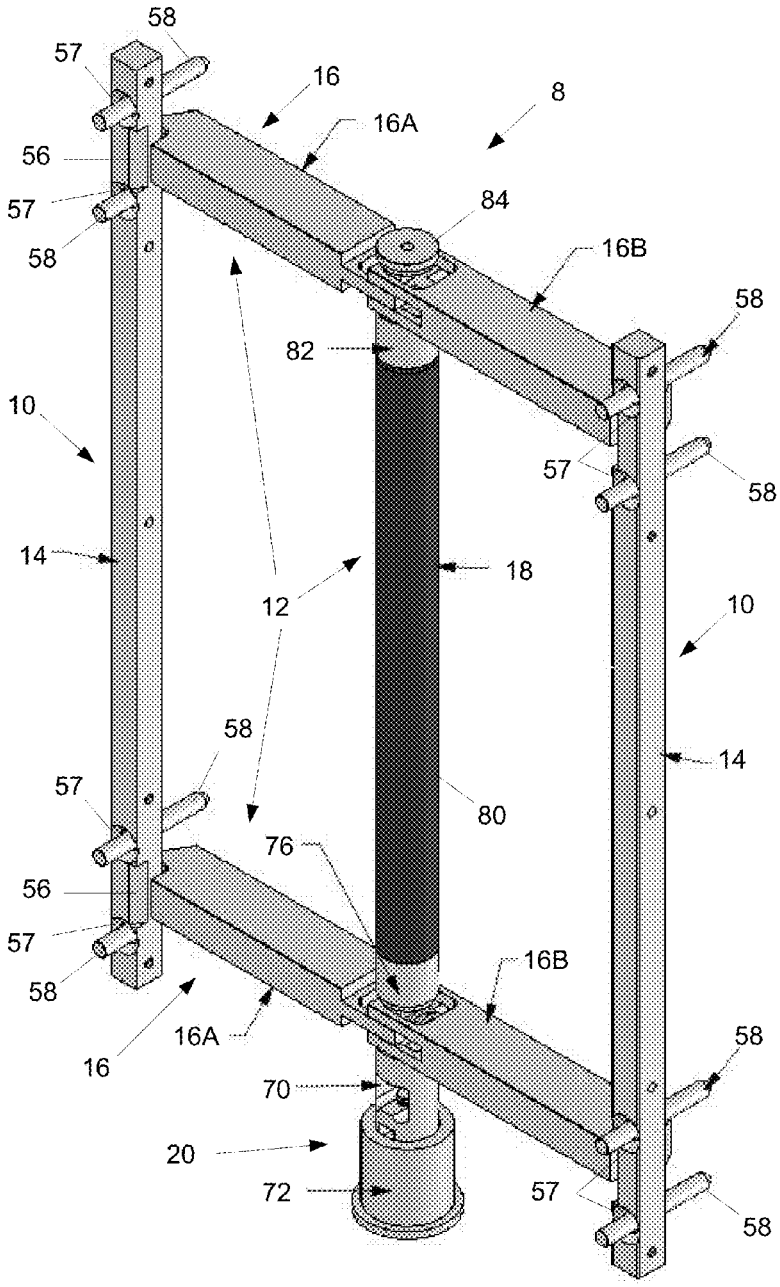
FIG. 2 is a perspective viewing the complete enclosure lock system.

As additionally shown in FIG. 2, the enclosure 2 further includes a lock system 8 for locking the cover to the base. The lock system 8 includes a base portion 10 on the base 4 and a cover portion 12 on the cover 6. The lock system base portion 10 includes a pair of first and second fixed lock bars 14 arranged in mutually parallel spaced relationship with each other. The lock system cover portion 12 includes one or more sets 16 of movable lock bars. In the example embodiment shown in FIGS. 1 and 2, two movable lock bar sets 16 are arranged in mutually parallel spaced relationship with each other. Additional movable lock bar sets could be added for enclosures of larger size. Alternatively, for smaller enclosures, a single movable lock bar set may suffice.

In the illustrated embodiment, each fixed lock bar 14 is formed from a single piece of bar stock made from steel or other high-strength material that is configured in the manner shown in FIG. 2. Each movable lock bar set 16 includes first and second movable lock bars 16A and 16B that can also be formed from steel bar stock made from steel or other high-strength material. The movable lock bars 16A and 16B are generally perpendicular to, and arranged to respectively engage, the first and second fixed lock bars 14. The locations where the movable lock bars 16A and 16B engage the fixed lock bars 14 will be referred to hereinafter as fixed lock bar catch portions (due to the fact that they retain the movable lock bars). The elongated span of the fixed lock bars 14 that lies between the catch portions will be referred to hereinafter as fixed lock bar stiffener portions (due to the fact that they stiffen the portions of the base on which the fixed lock bars are mounted). Depending on the number and location of the movable lock bar sets 16, the fixed lock bar stiffener portions may also extend above and below the fixed lock bar catch portions.

Figure 7A:
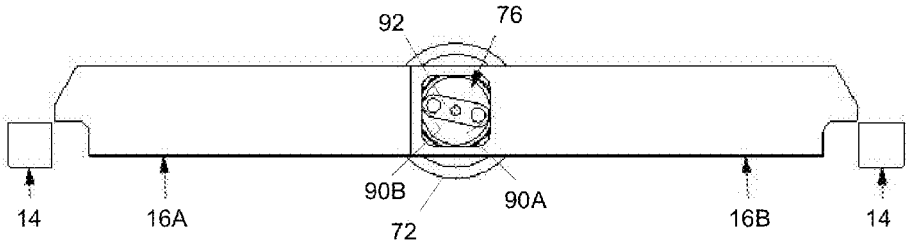
FIG. 7A is a top plan view showing an unlocking position of the enclosure lock system.
Figure 7B:
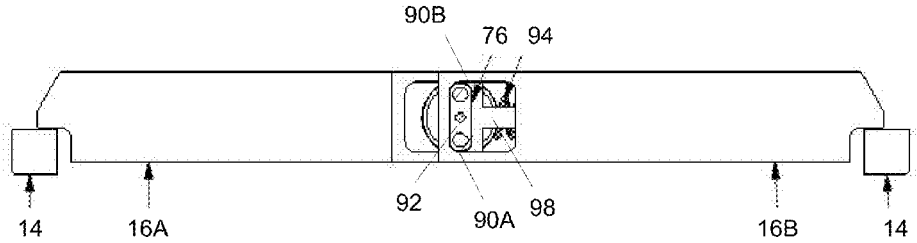
FIG. 7B is a top plan view showing a locking position of the enclosure lock system.

The lock system cover portion 12 further includes a lock bar retraction assembly 18 coupled to the movable lock bar sets 16 for retracting the movable lock bars 16A and 16B (preferably substantially simultaneously) out of engagement with the fixed lock bars 14 as the retraction assembly is rotated. The operation of the lock system 8 is described in more detail below. For now, it is sufficient to note that the movable lock bars have a refracted unlocked position (as shown in FIG. 7A) when the lock bar refraction assembly 18 is in one rotational orientation, and an extended lock position (as shown in FIG. 7B) when the retraction assembly is in a second rotational orientation. By way of example only, the first and second rotational orientations are approximately 90 degrees apart.

In the illustrated embodiment (with two movable lock bar sets 16), the lock system cover portion 12 is generally "I" shaped when the enclosure 2 is oriented as shown in the drawings. If the enclosure 2 was rotated 90 degrees, the lock system cover portion 12 would be generally "H" shaped. In either case, the lock system cover portion 6 lies generally parallel to the cover's front face. A security drive mechanism 20 is coupled to the refraction assembly 18 to drive the lock system 8. In an example embodiment shown in FIG. 3, the drive mechanism 20 comprises a lock 22 (e.g. a lock bolt) on the lock bar retraction assembly 18 that is configured to receive a security key (not shown) for rotating the refraction assembly. Although not shown, the face of the security lock 22 may have a curvilinear groove or ridge that matches a corresponding groove or ridge on the security key. Other designs that allow a security key to rotate the security lock 22 may also be used. Other types of security drive mechanism may also be provided, including but not limited to, motorized drive systems that may be key-operated or operated electronically, such as by using a radio control device in wireless communication with one or more servo drive units within the enclosure 2 that interoperate with the retraction assembly 18.

Figure 4:
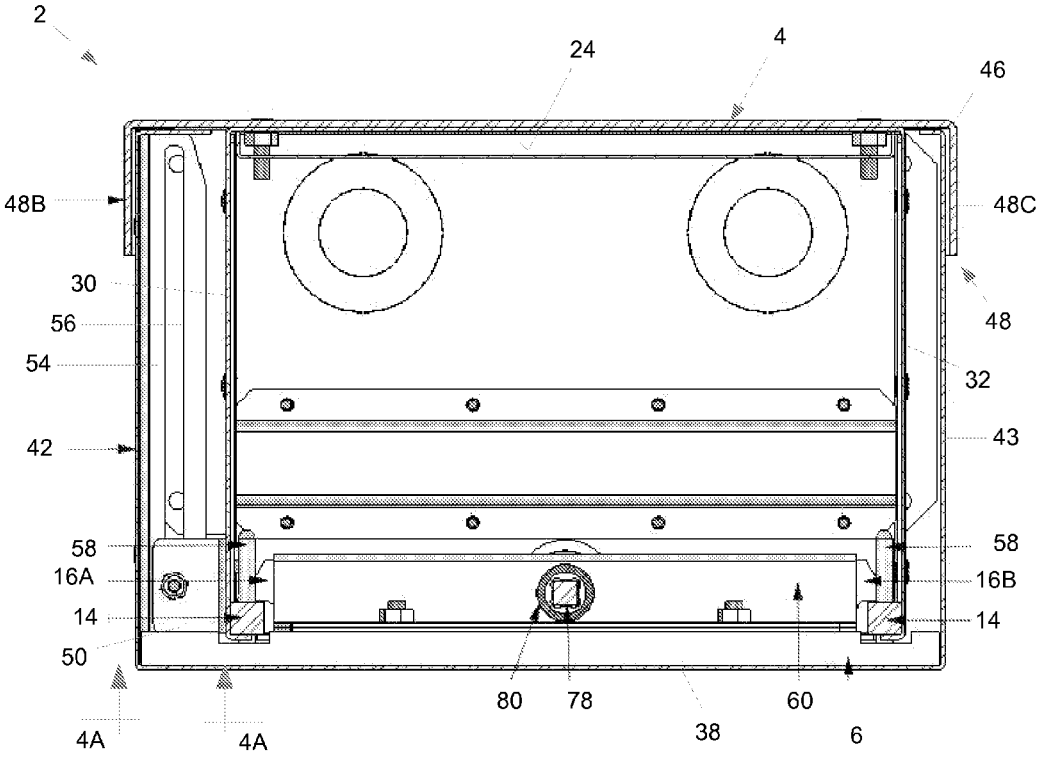
FIG. 4 is a cross-sectional view of the enclosure of FIG. 1 with the cover thereof in a closed position and looking downwardly on a portion of an enclosure lock system.

With additional reference now to FIG. 4, the cover 6 may be configured to enclose the base 4 in a nested relationship. In the illustrated embodiment, which represents only one example construction of the enclosure 2, the base 4 is formed with a back panel 24 and a set of four rectangular depth panels. As shown in FIG. 1, the base depth panels include an upper panel 26 and a bottom panel 28. As shown in both of FIGS. 1 and 4, the base depth panels further include two side panels 30 and 32. The base depth panels 24-32 extend forwardly from the peripheral edge of the back panel 24. As can be seen in FIG. 1, the back panel 24 and the depth panels 24-32 are arranged to form a rectangular box having a front opening 34 that leads to an equipment holding interior region 36 of the enclosure 2. The base depth panels 26-32 have a selected width dimension that defines a depth of the enclosure interior region 36.

The cover 6 has a front face panel 38 and its own set of four depth panels. As shown in FIG. 1, the cover depth panels include an upper panel 40 and a bottom panel 41. As shown in both of FIGS. 1 and 4, the cover depth panels further include two side panels 42 and 43. The cover depth panels 40-43 extend rearwardly from the peripheral edge of the face panel 38. As can be seen in FIG. 1, the face panel 38 and the cover depth panels 40-43 are arranged to form a rectangular box having a rear opening 44 that is larger than the front opening 34 of the base 4, thereby allowing the cover 6 to slide over the base. The cover depth panels 40-43 have a width dimension that is equal to or larger than the width dimension of the base depth panels 24-32. This allows the base 4 to completely nest within the cover 6 for added security against unauthorized access. A base bottom panel cutout 45 accommodates the components of drive mechanism 20.

With continuing reference to FIGS. 1 and 4, the enclosure 2 may be further provided with a backplate 46 that can be mounted to the back panel 24 of the base 4. The backplate 46 has a peripheral lip 48 that encloses portions of the back edge of the cover 6 when the latter is locked to the base 4 by the lock system 8. The backplate peripheral lip 48 is formed by flanges that are spaced from the base panels 26-32. These flanges include a top flange 48A, a pair of side flanges 48B and 48C, and a partial (or complete) bottom flange 48D. The backplate peripheral lip 48 provides additional security against unauthorized access into the enclosure 2.

Figure 4A:
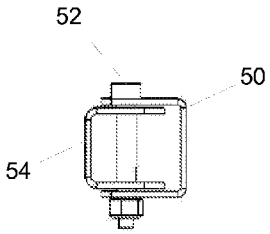
FIG. 4A is a cross-sectional view looking in the direction of arrows 4A-4A in FIG. 4 showing part of an upper hinge assembly of the enclosure of FIG. 1.
Figure 5A:
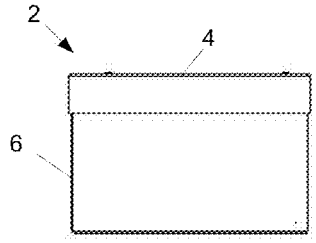
FIG. 5A is a top plan view showing the enclosure of FIG. 1 with the cover in a closed position.
Figure 5B:
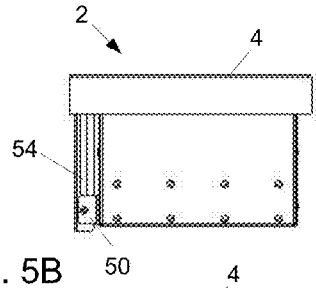
FIG. 5B is a diagrammatic top plan view corresponding to FIG. 5A but with only a hinge portion of the cover being shown in relation to the enclosure base.
Figure 5C:
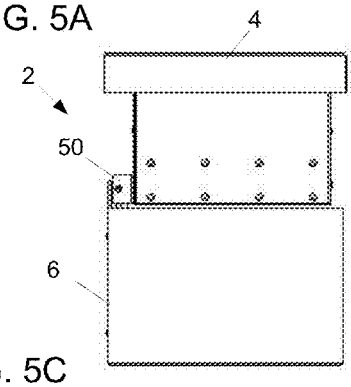
FIG. 5C is a top plan view showing the enclosure of FIG. 1 with the cover in a partially open position.
Figure 5D:
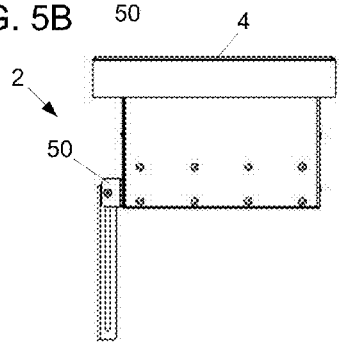
FIG. 5D is a diagrammatic top plan view corresponding to FIG. 5C but with only a hinge portion of the cover being shown in relation to the enclosure base.
Figure 5E:
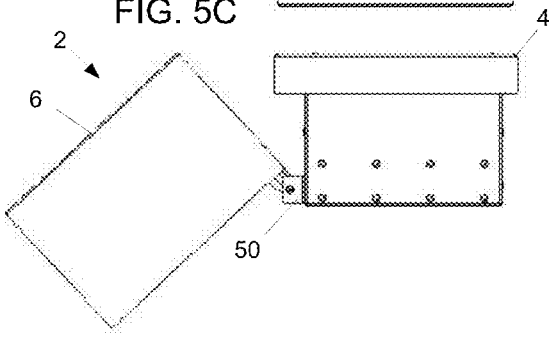
FIG. 5E is a top plan view showing the enclosure of FIG. 1 with the cover in a fully open position.
Figure 5F:
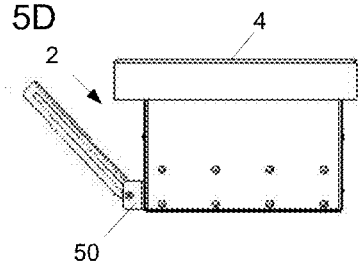
FIG. 5F is a diagrammatic top plan view corresponding to FIG. 5E but with only a hinge portion of the cover being shown in relation to the enclosure base.

The cover 6 is both pivotally and slidably mounted to the base 4. With reference to FIGS. 4 and 4A, the base 4 may include a pair of hinge mounts 50 attached to one of the base side panels (e.g., side panel 30) proximate to the base top and bottom panels 26 and 28. For larger enclosures, additional hinge mounts 50 may be provided. Each hinge mount 50 carries a hinge pin 52. The cover 6 includes a pair of slot members 54 having elongated slots 56 that ride on the hinge pins 52. The slots 56 are sufficiently long to allow the cover 6 to be pulled clear of its nested relationship with the box 4 during opening, at which point the cover can be pivoted to its fully open position. A reverse action is used for closing the cover. FIGS. 5A-5F illustrate several cover positions. FIG. 5A shows the cover 6 in its fully closed position. FIG. 5B shows the corresponding relationship between the base hinge mounts 50 and the cover slot members 54 in this position. FIG. 5C shows the cover 6 in a partially open position after it is has been pulled away from the base 4 to the full extent of the slidable range permitted by the cover slot members 54, but prior to the initiation of cover pivoting. FIG. 5D shows the corresponding relationship between the base hinge mounts 50 and the cover slot members 54 in this position. FIG. 5E shows the cover 6 after it has been pivoted and the cover is at or near its fully open position. FIG. 5F shows the corresponding relationship between the base hinge mounts 50 and the cover slot members 54 in this position.

Figure 3:
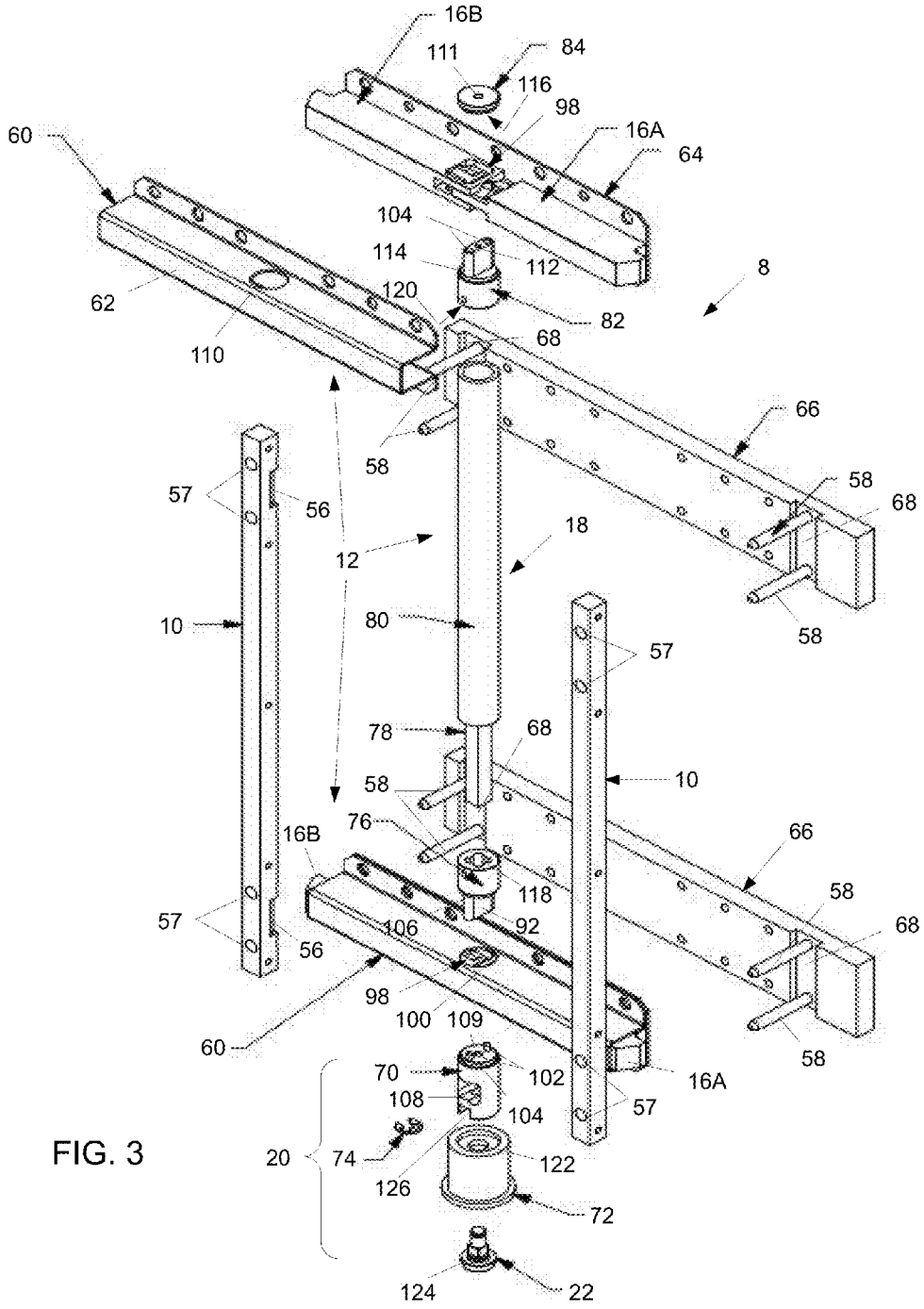
FIG. 3 is an exploded perspective view showing additional details of the enclosure lock system.

Returning now to FIGS. 1 and 4, the fixed lock bars 14 can be mounted to the base side panels 30 and 32. Preferably, the stiffener portions of the fixed lock bars 14 have higher stiffness than the side panel sheet structure. In the illustrated embodiment where the lock bars 14 are formed out of high-strength bar stock, the stiffener portions will be stiffer than the relatively thin sheet stock normally used to form the base side panels 30 and 32. An alternative fixed lock bar configuration is described below in connection with FIGS. 8-9. A rigid lock bar design provides improved security by resisting disengagement of the lock system base and cover portions 10 and 12 due to deformation of the base 4. As shown in FIGS. 1-3, the catch portions of the fixed lock bars 14 may be formed with angled striker plate surfaces 56 for retracting the ends of the movable lock bars 16A and 16B (which are themselves angled) when the cover 6 is closed.

In the illustrated embodiment, the fixed lock bars may also optionally include one or more apertures 57 (e.g., two) proximate to each catch portion where the fixed lock bars engage the movable lock bars 16A and 16B. The cover 6 may then optionally include registration pins 58 that are received in the apertures 57 when the cover 6 is locked to the base 4 by the lock system 8. This engagement of the registration pins 58 in the apertures 57 provides improved security by resisting disengagement of the lock system base and cover portions 10 and 12 due to deformation of the base 4. It also helps maintain the cover 6 in a proper orientation with respect to the base 4. An alternative cover guide design is described below in connection with FIGS. 8-9.

As can be seen in FIGS. 1, 3 and 4, the movable lock bars 16A and 16B are slidable within bracket assemblies 60 mounted on the cover front panel 38. As best shown in FIG. 3, the bracket assemblies 60 may each include a U-shaped bracket component 62, a base plate 64 and a stiffening backing member 66. The bracket assemblies 60 are preferably stiff relative to the cover front panel 38. This provides improved security by resisting disengagement of the lock system base and cover portions 10 and 12 due to deformation of the cover 6. The stiffening backing member 66 of each bracket assembly 60 is attached to the cover front panel 38. It may be used to support the base of the registration pins 58 within a pair of vertical channels 68. The channels 68 are sized and arranged to receive the fixed lock bars 14 when the cover 6 is locked to the base 4 by the lock system 8.

As can be seen in FIGS. 2 and 3, the lock bar retraction assembly 18 includes a lower first actuator 70 as part of the drive mechanism 20. The drive mechanism 20 may also include a cup 72 in which the security lock 20 is disposed for protection from the elements. A clip 74 may be used to captivate the lock 22 into the cup 72 and the first actuator 70. A lower first cam 76 is driven by the first actuator 70 and is operatively coupled to a lower first one of the movable lock bar sets 16. An upper second actuator 78 is driven by the lower cam 76. A shroud 80 may be provided that spins freely around the second actuator 78. An upper second cam 82 is driven by the second actuator 78 and is operatively coupled to an upper second one of the movable lock bar sets 16. An upper cap 84 is mounted to the upper cam 82 at the top of the lock bar refraction assembly 18.

Figure 6:
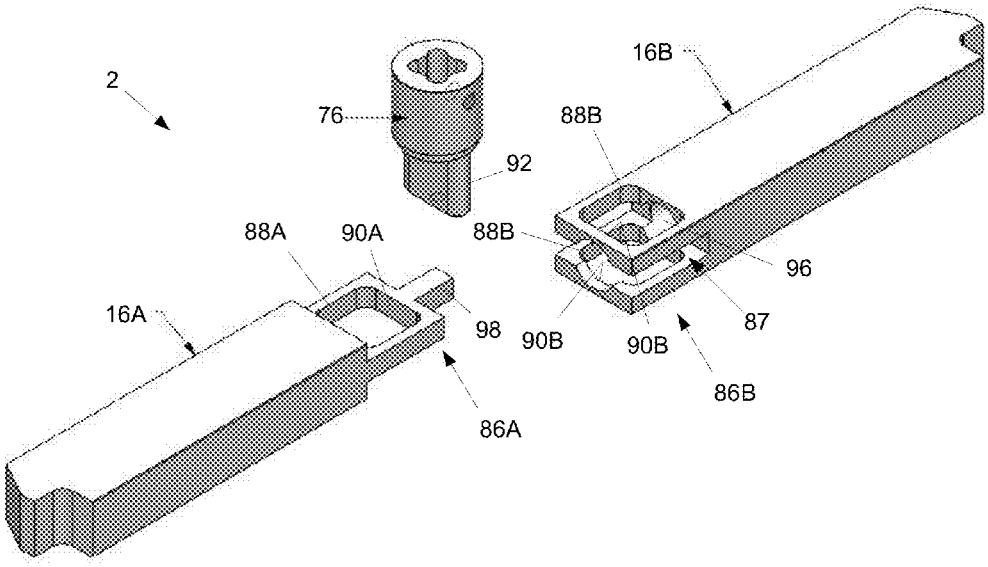
FIG. 6 is an exploded perspective view showing further details of the enclosure lock system.

FIGS. 6, 7A and 7B illustrate the lower movable lock bar set 16 that is driven by the lower cam 76. As shown, the first and second movable lock bars 16A and 16B have nested cam-engaging ends 86A and 86B, respectively, that are arranged to slide relative to each other along a common axis when driven by the lower cam 76. Although not illustrated, the upper movable lock bar set 16 and the upper cam 82 are constructed in identical fashion. It will be seen that the cam-engaging end 86B of the movable lock bar 16B is forked to provide a gap 87 for slidably receiving the cam-engaging end 86A of the movable lock bar 16A. The movable lock bar cam-engaging ends 86A and 86B respectively include overlapping cam-receiving slots 88A and 88B. Because the cam-engaging end 86B of the movable lock bar 16B is forked, it has two cam-receiving slots 88B, one upper and one lower. Each cam-receiving slot 88A and 88B is formed with a respective cam-follower end member 90A and 90B. Again, because the cam-receiving slot 88B is forked, it has two cam-follower end members 90B, one upper and one lower.

The cam 76 has an elongated cam member 92 that is trapped within the interior of the overlapping cam-receiving slots 88A and 88B in order to engage the opposing cam-follower end members 90A and 90B. When the lock bar retraction assembly 18 is in its non-refracting rotational position, the narrow dimension of the cam member 92 engages the cam-follower end members 90A and 90B, as shown in FIG. 7B. When the lock bar refraction assembly 18 is in its retracting rotational position, the cam member 92 is rotated so that its wide dimension pushes apart the cam-follower end members 90A and 90B. This increases the amount of overlap of the movable lock bars 16A and 16B, and refracts them out of engagement with the fixed lock bars 14. Note that the long dimension of the cam member 92 and the width of the cam-receiving slots 88A and 88B may be enlarged in order to increase the throw of the movable lock bars 16A and 16B during retraction. Similarly, reducing these dimensions (or at least the long dimension of the cam member 92) will decrease the movable lock bar throw. As previously mentioned, the configuration and operation of the upper movable lock bar set 16 is exactly the same.

The first and second movable lock bars 16A and 16B of the upper and lower movable lock bar sets 16 can be resiliently biased into engagement with the fixed lock bars 14. As shown in FIG. 7B, this biasing may be provided by a coil compression spring 94. One end of the spring 94 is captured in a blind bore 96, which can be seen in FIG. 6 at the base of the fork gap 87 of the movable lock bar 16B. The other end of the spring 94 engages the movable lock bar 16B. In particular, the spring 94 is received on a post 98 that extends from the cam-engaging end 86A of the movable lock bar 16A. The post 98 helps stabilize the spring 94. It is sized to be received in the blind bore 96 of the movable lock bar 16B.

It will be seen in FIG. 3 that the upper and lower pairs of movable lock bars 16A and 16B are nested together within the upper and lower U-shaped bracket components 62 and base plates 64 of the bracket assemblies 60. The compression spring 94 acts between the movable lock bars 16A and 16B so that these bars are forced outwardly into engagement with the fixed lock bars 14. Nesting together the ends of the movable lock bars 16A and 16B creates upper and lower cam-receiving pockets 98, each of which is provided by the overlapping cam-receiving slots 88A and 88B formed at the cam-engaging ends 86A and 86B of the lock bars. The cam-receiving pockets 98 are shown as being located on the centerline of the cover lock assembly 12, which is also the centerline of the lock bar retraction assembly 18. Depending on design preferences, the cover lock assembly 12 also could be designed so that the lock bar retraction assembly 18 and the cam-receiving pockets 98 are offset from the cover lock assembly centerline.

Still referring to FIG. 3, the cover lock assembly 12 may be assembled in the following manner. The first actuator 70 may be inserted through a lower one of a pair of circular openings 100 formed in the lower U-shaped bracket component 62. The lower cam 76 is likewise inserted through an upper one of the circular openings 100 in the lower U-shaped bracket component 62. With the lower lock bars 16A and 16B pushed toward each other to form the lower cam-receiving pocket 98, and the lower cam 76 is advanced into this pocket. Two pins 102 on the first actuator 70 engage a pair of holes 104 that are formed in both the lower cam 76 and the upper cam 82 (note that only the upper cam holes 104 are visible in FIG. 3). This coupling forces the the first actuator 70 and the lower cam 76 to rotate together. There is an upwardly-facing shoulder 104 on the first actuator 70 and a downwardly-facing shoulder 106 on the lower cam 76. Each shoulder 104 and 106 is larger than the circular openings 100 in the lower U-shaped bracket component 62 in order to keep the first actuator 70 and the lower cam 76 from sliding through the lower bracket assembly 60. The first actuator 70 and the lower cam 76 may be held together using a small coupling screw (not shown) inserted through a clearance pocket 108 in the side of the first actuator. The coupling screw extends upwardly through a small hole 109 in the top of the actuator 70 and is received in a threaded bore (not shown) formed at the bottom of the cam member 92 of lower cam 76. This creates a lower subassembly of the lock system cover portion 12.

An upper subassembly of the lock system cover portion 12 may be assembled in similar fashion. The upper cam 82 can be inserted through a lower one of a pair of circular openings 110 formed in the upper U-shaped bracket component 62. With the upper lock bars 16A and 16B pushed toward each other to form the upper cam-receiving pocket 98, and the upper cam 82 is advanced into this pocket. The upper cap 84 is then inserted into an upper one of the circular openings 110 in the upper U-shaped bracket channel component 62. The upper cap 62 and the upper cam 82 are held together with a small coupling screw (not shown). The coupling screw extends downwardly through a small hole 111 in the top of the upper cap 84 and is received in a threaded bore 112 formed at the top of the cam member 92 of upper cam 82. This creates the upper subassembly of the lock system cover portion 12. There is a shoulder 114 on the upper cam 82, as well as a shoulder 116 on the upper cap 84. Each shoulder 114 and 116 is larger than the circular openings 110 in the upper U-shaped bracket component 62 in order to keep these components from sliding through the upper bracket assembly 60.

The shroud 80 may now be slid over the second actuator 78. As previously mentioned, the shroud 80 is sized to spin freely around the second actuator 78 when the actuator is installed. The second actuator 78 may be configured with a square cross-section (e.g., as a square bar, a four-sided square tube, a three-sided channel, etc.). The upper and lower ends of the second actuator 78 are respectively inserted into square pockets 118 and 120 in the lower and upper cams 76 and 82, and held in place using a small set screw (not shown). Note that instead of providing the square pockets 118 and 120, the lower and upper cams 76 and 82 could each be formed with square posts that extend into corresponding square openings in the ends of the second actuator 78. If the second actuator 78 is made from square tube or channel stock, such end openings would already exist. If the second actuator 78 is made from bar stock, the end openings would need to be fabricated. Other shapes could also be used to key the second actuator 78 to the cams 76 and 82.

The foregoing assembly may now be attached to the cover 6 by bolting the upper and lower U-shaped brackets 62 (with the base plates 64) to the upper and lower backing members 66, which may be welded to the inside of the cover's front panel 38. The lock bolt 22 is then inserted through an opening 122 in the top of the cup 72 and into a corresponding opening (not shown) in the bottom of the first actuator 70. The lock bolt 22 contains a square extrusion 124 that engages into a square pocket 126 at the bottom within the first actuator 70. The lock bolt 22 is secured in place by installing the retaining clip 74 through the clearance pocket 108 in the side of the first actuator 1 and around a groove (not shown) machined or otherwise formed in the lock bolt.

The lock bolt 22 is actuated through the engagement and rotation of a security key after the key is inserted into the cup 72. The rotation of the lock bolt 22 forces rotation of the first actuator 70, which in turn rotates the lower cam 76 of the lock system cover portion lower subassembly, the second actuator 78, and the upper cam 82 of the lock system cover portion upper subassembly. This draws both sets of the movable lock bars 16A and 16B inwardly, causing them to disengage from both of the fixed lock bars 14. Advantageously, clearances may be built into each of the parts to eliminate the need for bearings, bushings, or grease between the moving components.

Having now described an example embodiment of a high-security enclosure, it will be appreciated that the enclosure and its various components may be modified to provide various alternative embodiments. For example, it would be possible to modify the lock system 8 so that the fixed lock bars 14 are not elongated. In that case, there could be a pair of fixed lock bar segments on each side of the base that are respectively positioned to engage the upper and lower movable lock bar sets. These lock bar segments could be quite short, perhaps only long enough to engage the movable lock bars 16A and 16B. According to another embodiment, it would be possible to integrate the fixed lock bars 14 with the base side panels 30 and 32, as for example, by forming the base 2 as a molded structure made from a high strength polymer, or to provide such integrated lock bars with additional strength members (such as steel reinforcement plates).

Figure 8:
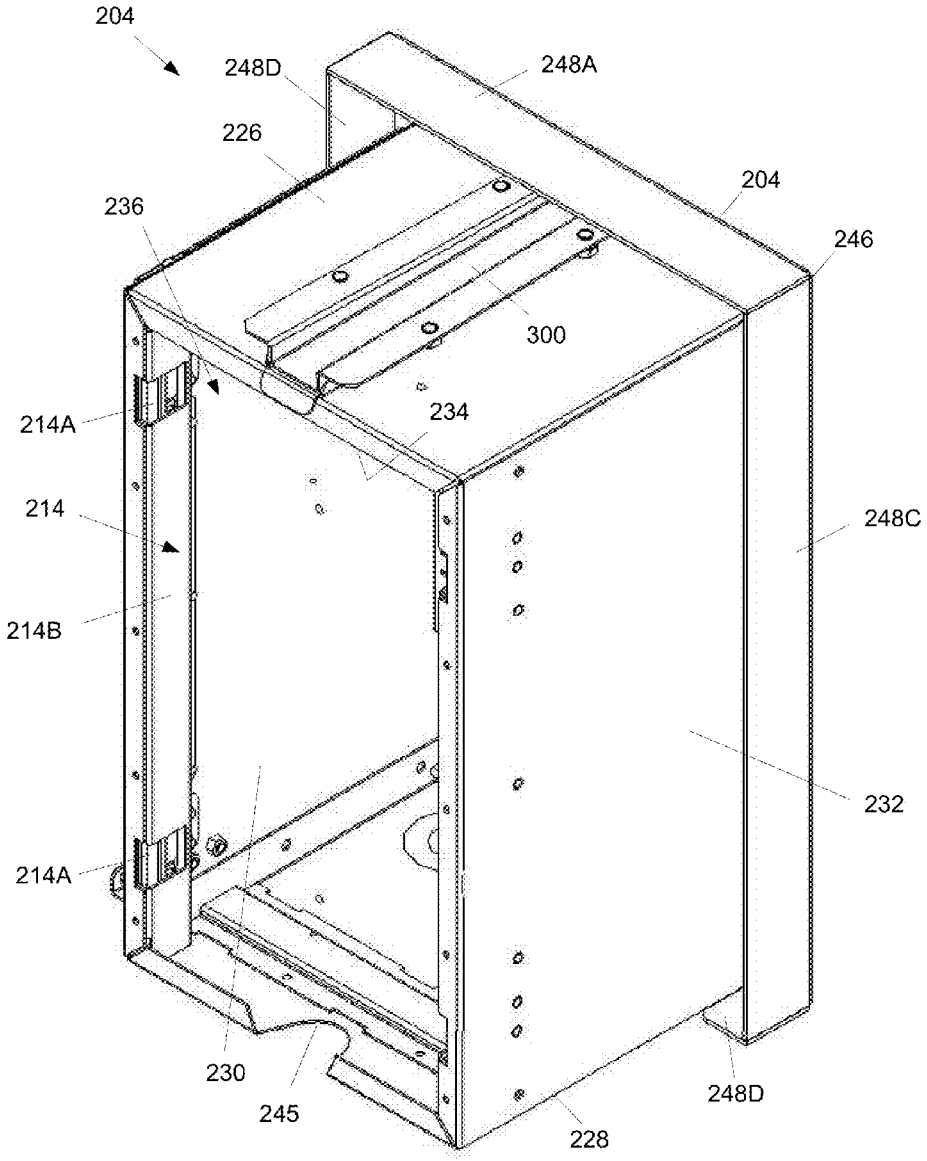
FIG. 8 is a perspective view showing the base of an alternative embodiment of a high-security enclosure with an alternative fixed lock bar assembly.
Figure 8A:
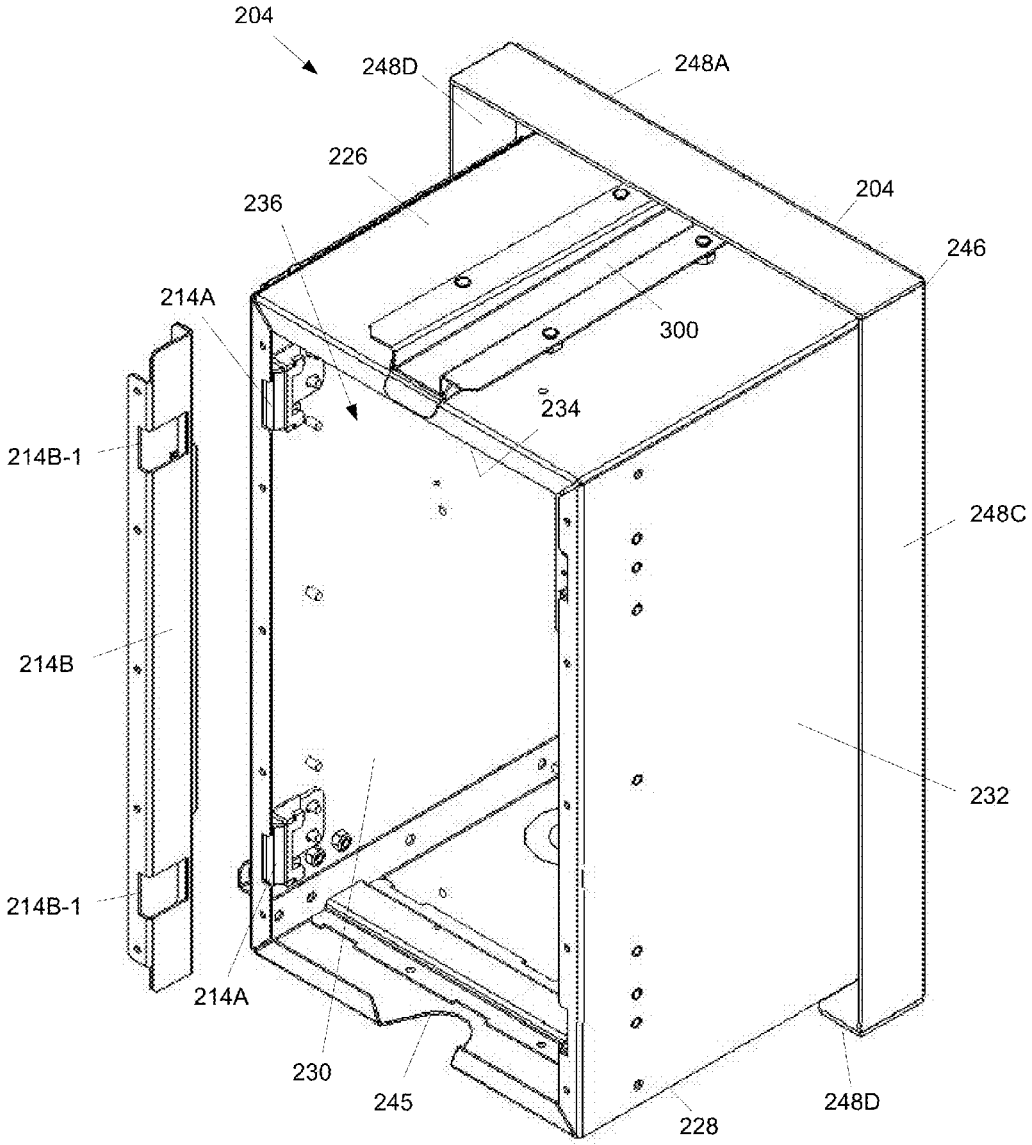
FIG. 8A is a perspective view showing the base of FIG. 8 with a stiffener portion of the fixed lock bar assembly removed to illustrate a catch portion thereof.
Figure 8B:
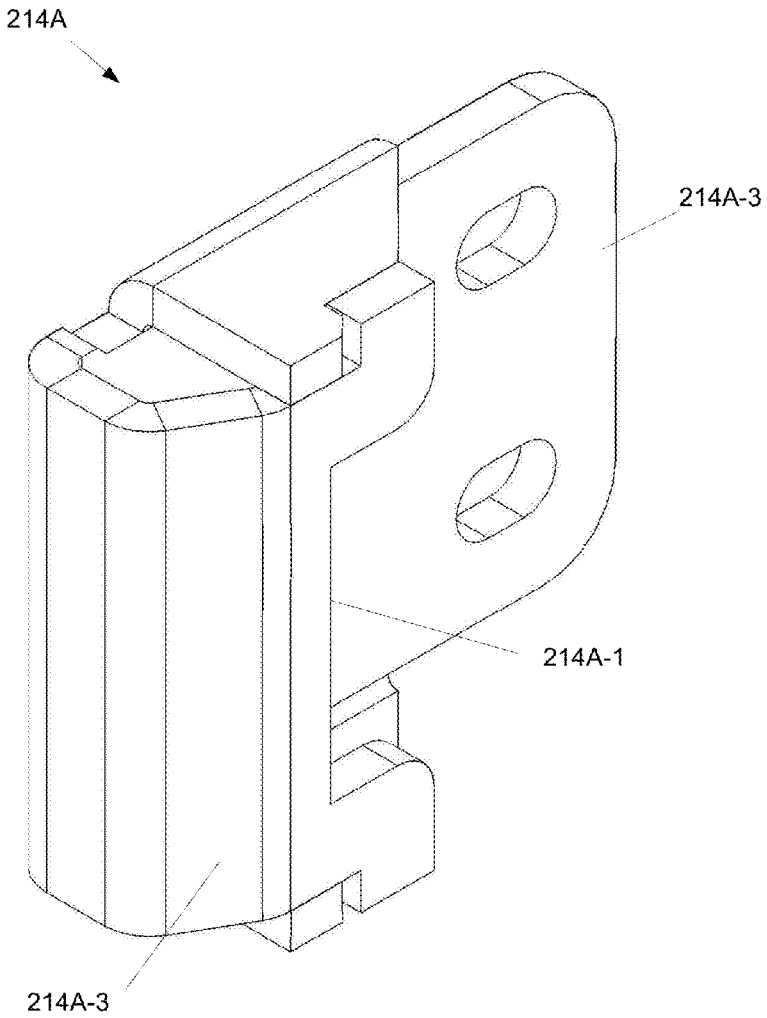
FIG. 8B is an enlarged perspective view showing the catch portion of the fixed lock bar arrangement of FIG. 8A.

FIG. 8 illustrates another alternative embodiment in which the enclosure 2 utilizes a modified enclosure base 204 with a modified fixed lock bar configuration and a modified design for orienting the enclosure base and cover portions. Except as described herein, the base 204 is identical to the base 4, as shown by the use of corresponding reference numbers that are incremented by 200. The base 204 differs from the previously described base 4 in that the fixed lock bars 214 are formed as lock bar assemblies that includes several components. In particular, as additionally shown in FIGS. 8A and 8B, the lock bar 214 includes a pair of catch fittings 214A and a stiffener 214B. The catch fittings 214A may be formed from steel sheet stock into the configuration shown in FIG. 8B. In this configuration, the catch fittings 214A include a catch portion 214A-1 that catches and retains the movable lock bars 16A and 16B when the cover 6 is closed. The catch fittings 214A also include an angled striker plate portion 214A-1 that engages and depresses the angled ends of the movable lock bars 16A and 16B C as the cover 6 is closing. The catch fittings 214A further include a mounting portion 214A-3 that may be formed with apertures for receiving mounting bolts for attaching the catch fittings to the base 204. As shown in FIG. 8A, the stiffener 214B is formed as a channel member with a pair of openings 214B-1 that are sized to expose the catch fittings 214A. The stiffener 214B also includes mounting flanges for attaching the stiffener to the base 204.

Figure 9:
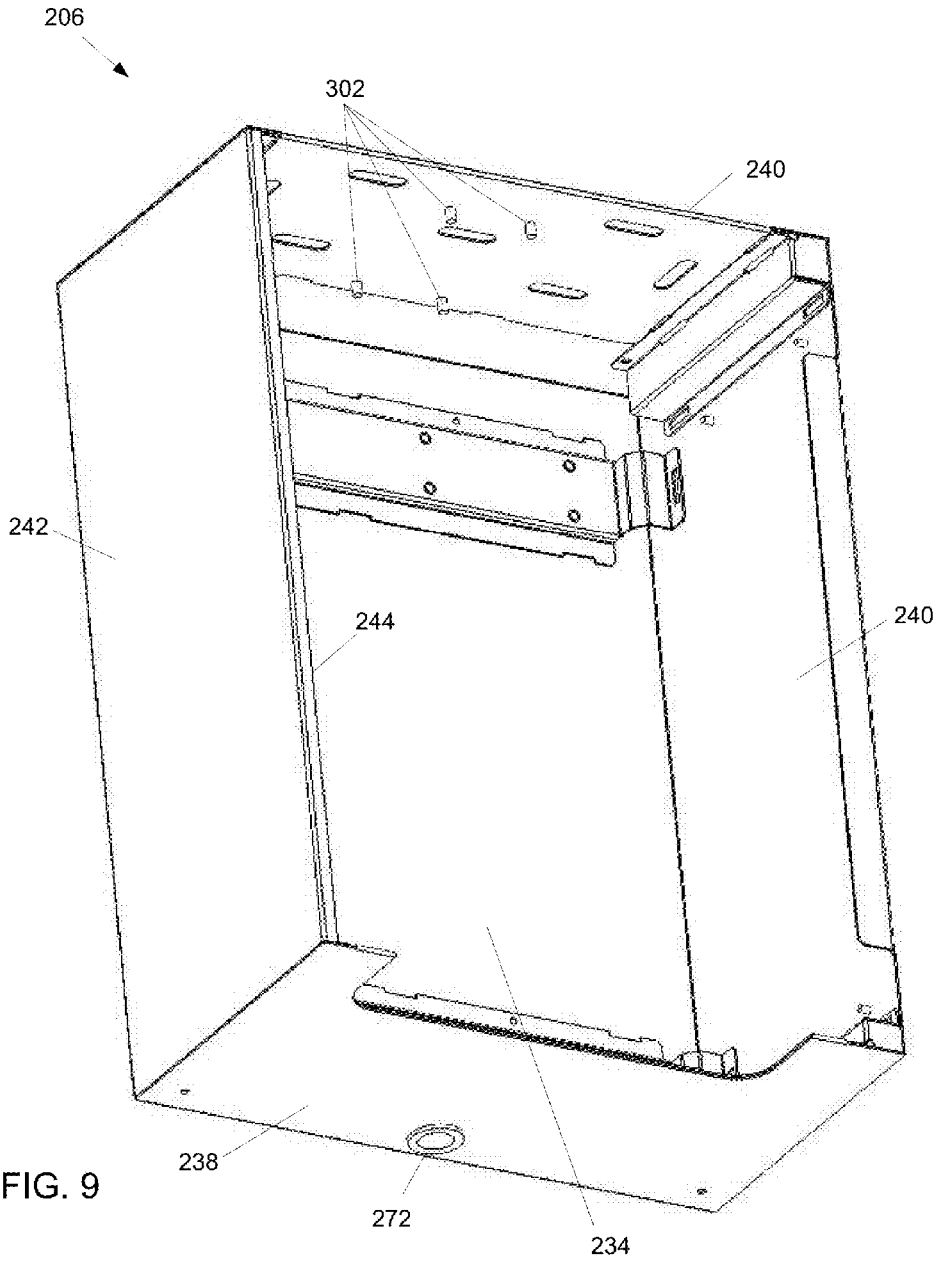
FIG. 9 is a perspective view showing a partially assembled cover designed to mount to the base of FIG. 8.

FIGS. 8 and 8A further illustrate that the base 204 may include a post guide channel 300 mounted to the top depth panel 226. FIG. 9 illustrates a modified cover 206 whose top depth panel 240 is formed with guide posts 302. The cover guide posts 302 are positioned to engage the sides of the post guide channel 300 as the cover 206 is closed. This engagement helps guide the cover 206 during the closure operation.

According to a further design modification of the lock system 8, there may be a single fixed lock bar 14 or 214 on the side of the base 2 or 206 that is opposite from the hinge connection(s) to the cover 6. The lock system cover portion 12 may then be redesigned so that the movable lock bar sets 16 are each reduced to only a single lock bar that engages the single fixed lock bar. This modification may also require that the cover-base hinge connection allow pivoting only, with no sliding motion.

Figure 10:
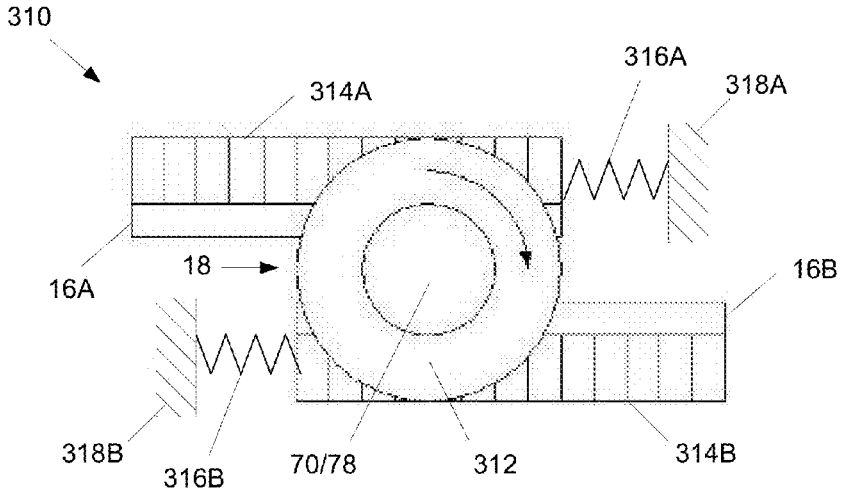
FIG. 10 is a diagrammatic plan view showing the operation of an alternative enclosure lock system.
Figure 11:
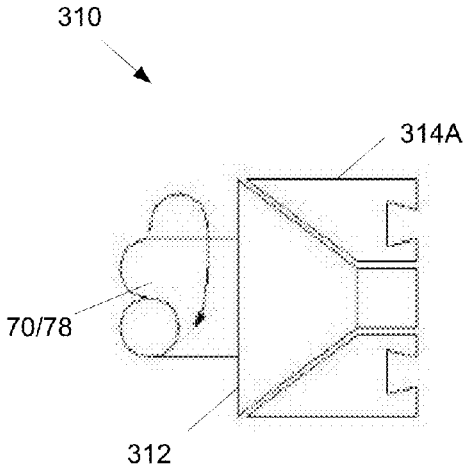
FIG. 11 is a diagrammatic side elevation view showing the alternative enclosure lock system system of FIG. 10.

Turning now to FIGS. 10 and 11, an alternative connection arrangement 310 is shown that may be used for interconnecting the lock bar retraction assembly 18 to the movable lock bars 16A and 16B. The connection arrangement 310 is a gear drive system wherein upper and lower bevel gears 312 on the lock bar retraction assembly 18 engage upper and lower pairs of rack gears 314A and 314B on the upper and lower sets of movable lock bars 16A and 16B. In this embodiment, the cams 76 and 82 are not used. The lower bevel gear 312 can be driven by a modified version of the first actuator 70 and the upper bevel gear 312 can be driven by a modified version of the second actuator 78. Lock bar biasing to the locking position may be provided by compression springs 316A and 316B. The springs 316A and 316B may respectively engage the rack gears 314A and 314B, and may be respectively anchored to fixed structures 318A and 318B formed as part of the bracket assemblies 60. Other biasing arrangements could also be used.

Figure 12:
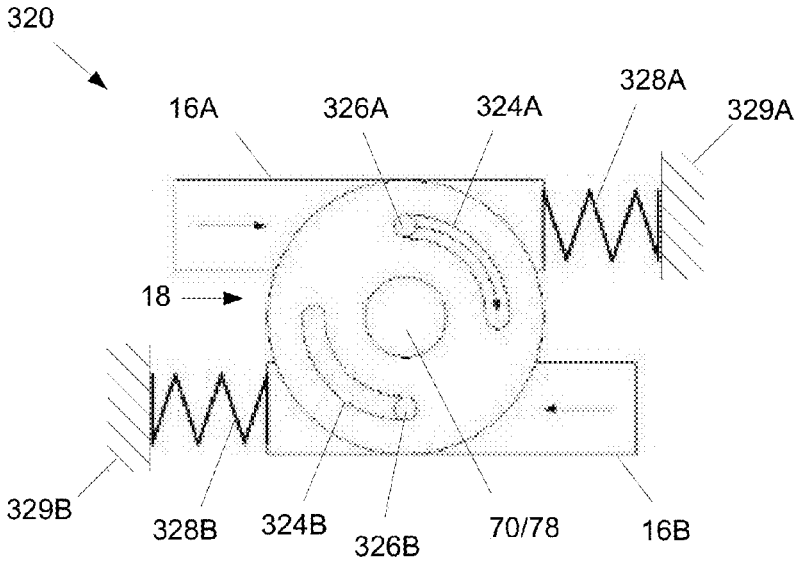
FIG. 12 is a diagrammatic plan view showing the operation of a further alternative enclosure lock system.

FIG. 12 illustrates another alternative connection arrangement 320 that may be used for interconnecting the lock bar retraction assembly 18 to the movable lock bars 16A and 16B. In the connection arrangement 320, a pair of upper and lower cam wheels 322 on the lock bar retraction assembly 18 each have arcuate cam slots 324A and 324B that respectively drive pins 326A and 326B on the movable lock bars 16A and 16B. In this embodiment, the cams 76 and 82 are not used. The lower cam wheel 322 can be driven by a modified version of the first actuator 70 and the upper cam wheel 322 can be driven by a modified version of the second actuator 78. Lock bar biasing to the locking position may be provided by compression springs 328A and 328B. The springs 320A and 320B may respectively engage the movable lock bars 16A and 16B, and may be respectively anchored to fixed structures 329A and 329B formed as part of the bracket assemblies 60. Other biasing arrangements could also be used.

Figure 13:
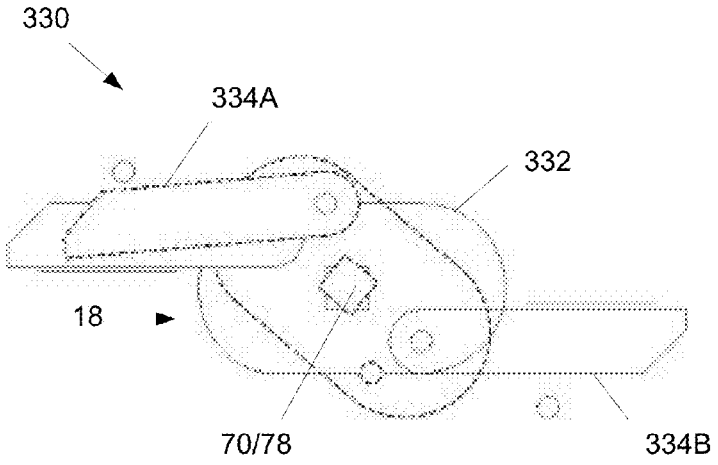
FIG. 13 is a diagrammatic plan view showing the operation of a still further alternative enclosure lock system.

FIG. 13 illustrates another alternative connection arrangement 330 that may be used for interconnecting the lock bar refraction assembly 18 to the movable lock bars 16A and 16B. In the connection arrangement 330, a double-ended crank 332 on the lock bar retraction assembly 18 whose ends are pinned to intermediate links 324A and 324B that are also pinned to the movable lock bars 16A and 16B (not shown). In this embodiment, the cams 76 and 82 are not used. The lower crank 332 can be driven by a modified version of the first actuator 70 and the upper crank 332 can be driven by a modified version of the second actuator 78. Lock bar biasing to the locking position may be provided by compression springs (not shown) that engage the movable lock bars 16A and 16B in the manner shown in FIG. 12. Other biasing arrangements could also be used.

Accordingly, a high-security enclosure has been disclosed. Although several example embodiments have been shown and described, it should be apparent that many variations and additional alternative embodiments could be implemented in accordance with the teachings herein. It is understood, therefore, that the invention is not to be in any way limited except in accordance with the spirit of the appended claims and their equivalents.

What is claimed is:

1. A high-security enclosure, comprising:

a base;

a cover;

said cover having side portions configured to enclose side portions of said base in a nested relationship;

a lock system for locking said cover to said base;

said lock system including a base portion on said base and a cover portion on said cover;

said lock system base portion including a pair of first and second fixed lock bars arranged in mutually parallel spaced relationship with each other;

said lock system cover portion including one or more sets of movable lock bars arranged in mutually parallel spaced relationship with each other;

each movable lock bar set including first and second movable lock bars that are generally perpendicular to, and arranged to respectively engage, said first and second fixed lock bars;

said lock system cover portion further including a lock bar retraction assembly coupled to said movable lock bar sets for refracting said movable lock bars out of engagement with said fixed lock bars; and a security drive mechanism coupled to said lock bar refraction assembly to drive said lock system.

2. The enclosure of claim 1 wherein said fixed lock bars each include one or more catch members for engaging a movable lock bar of said one or more movable lock bar sets.

3. The enclosure of claim 1 wherein said fixed lock bars each include at least two catch members.

4. The enclosure of claim 1 wherein said fixed lock bars are elongated.

5. The enclosure of claim 1 wherein said fixed lock bars are stiff relative to a portion of said base on which said fixed lock bars are mounted to provide improved security by resisting disengagement of said lock system base and cover portions due to deformation of said base.

6. The enclosure of claim 1 wherein said fixed lock bars each include one or more catch portions for engaging a movable lock bar of said one or more movable lock bar sets, and a stiffener portion for stiffening portions of said base on which said fixed lock bars are mounted.

7. The enclosure of claim 6 wherein said one or more catch portions and said stiffener portion are integrally formed on a piece of bar stock.

8. The enclosure of claim 6 wherein said one or more catch portions are provided by one or more catch fittings and said stiffener portion is provided by a separate stiffener channel.

9. The enclosure of claim 8 wherein said stiffener channel mounts over said one or more catch fittings and includes apertures for exposing said one or more catch fittings.

10. The enclosure of claim 1 wherein said fixed lock bars include at least one aperture proximate to each location where said fixed lock bars engage said movable lock bars, and wherein said cover includes registration pins that are received in said apertures when said cover is locked to said base by said lock system, said engagement of said registration pins in said apertures providing improved security by resisting disengagement of said lock system base and cover portions due to deformation of said base.

11. The enclosure of claim 1 wherein said movable lock bars are slidable within bracket assemblies mounted on said cover, said bracket assemblies being stiff relative to portions of said cover on which said bracket assemblies are mounted to provide improved security by resisting disengagement of said lock system base and cover portions due to deformation of said cover.

12. The enclosure of claim 11 wherein said bracket assemblies each include a stiffening backing member mounted to said cover.

13. The enclosure of claim 1 wherein said cover includes one or more guide posts that register with one or more corresponding post guides on said base.

14. The enclosure of claim 13 wherein said base further includes one or more backplate flanges that enclose back edges of one or more of said cover side portions when said cover encloses said base.

15. The enclosure of claim 1 wherein said lock system cover portion is generally "I" or "H" shaped and oriented parallel to a front wall of said cover.

16. The enclosure of claim 1 wherein said lock bar retraction assembly includes a first actuator driven by said security lock, a first cam driven by said first actuator and operatively coupled to a first one of said movable lock bar sets, a second actuator driven by said first cam, and a second cam driven by said second actuator and operatively coupled to a second one of said movable lock bar sets.

17. The enclosure of claim 16 wherein said first and second movable lock bars of each movable lock bar set have nested cam-engaging ends that are arranged to slide relative to each other along a common axis when driven by one of said cams.

18. The enclosure of claim 17 wherein said movable lock bar cam-engaging ends include overlapping cam-receiving slots that are each formed with a cam-follower end member, and wherein said first and second cams are each trapped within a pair of said overlapping cam-receiving slots in order to engage an opposing pair of said cam-follower end members.

19. The enclosure of claim 18 wherein said first and second movable lock bars of said movable lock bar sets are resiliently biased into said engagement with said fixed lock bars.

20. The enclosure of claim 1 wherein said one or more movable lock bar sets include rack gears that are driven by a gear on said lock bar retraction assembly.

21. The enclosure of claim 1 wherein said one or more movable lock bar sets include drive pins that are driven by a drive wheel on said lock bar retraction assembly.

22. The enclosure of claim 1 wherein said one or more movable lock bar sets include drive links that are linked to a drive crank on said lock bar retraction assembly.

23. The enclosure of claim 1 wherein said security drive mechanism comprises a security lock on said retraction assembly configured to receive a security key for actuating the retraction assembly.

24. A high-security enclosure, comprising:

a base;

a cover pivotally mounted to said base;

a lock system for locking said cover to said base;

said lock system including a base portion on said base and a cover portion on said cover;

said lock system base portion including one or more elongated fixed lock bars on an inside of said base, said one or more fixed lock bars each including one or more catch portions and one or more elongated stiffener portions stiffening one or more wall portions of said base;

said lock system cover portion including one or more movable lock bars on an inside front wall of said cover, said one or more movable lock bars being generally perpendicular to, and arranged to engage, said one or more fixed lock bar catch portions;

said lock system cover portion further including a lock bar retraction assembly coupled to said one or more movable lock bars for retracting said movable lock bar(s) out of engagement with said one or more fixed lock bars, said movable lock bars and said lock bar retraction assembly being oriented generally parallel to said cover front wall, and said lock bar retraction assembly being oriented generally perpendicular to said movable lock bars; and a security drive mechanism coupled to said lock bar refraction assembly to drive said lock system, said security drive mechanism being substantially axially aligned with said lock bar retraction assembly.

25. A high-security enclosure, comprising:

a base;

a cover that is both pivotally and slidably mounted to said base;

a lock system for locking said cover to said base;

said lock system including a base portion on said base and a cover portion on said cover;

said lock system base portion including a pair of first and second fixed lock bars arranged in mutually parallel spaced relationship with each other;

said lock system cover portion including one or more sets of movable lock bars arranged in mutually parallel spaced relationship with each other;

each movable lock bar set including first and second movable lock bars that are generally perpendicular to, and arranged to respectively engage, said first and second fixed lock bars;

said lock system cover portion further including a lock bar retraction assembly coupled to said movable lock bar sets for refracting said movable lock bars out of engagement with said fixed lock bars;

a security drive mechanism coupled to said lock bar refraction assembly to drive said lock system;

said fixed lock bars each include one or more catch portions for engaging a movable lock bar of said one or more movable lock bar sets, and a stiffener portion for stiffening portions of said base on which said fixed lock bars are mounted;

said one or more catch portions and said stiffener portions being either integrally formed on a piece of bar stock, or being respectively provided by one or more catch fittings and a separate stiffener channel;

said movable lock bars being slidable within bracket assemblies mounted on said cover, said bracket assemblies being stiff relative to portions of said cover on which said bracket assemblies are mounted to provide improved security by resisting disengagement of said lock system base and cover portions due to deformation of said cover;

said cover being configured to enclose said base in a nested relationship and said base including one or more backplate flanges that enclose one or more portions of said cover when said cover encloses said base;

said lock bar retraction assembly including one or more lock bar engaging members operatively coupled to said one or more movable lock bar sets and one or or more actuators arranged to drive one or more said lock bar engaging members;

said one or more lock bar engaging members being selected from the group consisting of cams, gears, drive wheels and drive cranks;

said first and second lock bars of said one or more movable lock bar sets being biased into said engagement with said fixed lock bars; and said security drive mechanism comprising a security lock on said retraction assembly configured to receive a security key for actuating said retraction assembly.

* * * * *